United States Patent [19]

Guest

[11] 4,422,819

[45] Dec. 27, 1983

[54] FOLD-AWAY FORK LIFT FOR LOADERS

[75] Inventor: William H. Guest, Torrington, Conn.

[73] Assignee: Guest Industries, Inc., Torrington, Conn.

[21] Appl. No.: 256,245

[22] Filed: Apr. 21, 1981

[51] Int. Cl.[3] ..... E02F 3/70

[52] U.S. Cl. ..... 414/724; 414/607; 414/912; 37/117.5

[58] Field of Search ..... 414/724, 912, 607, 608, 414/618–622, 642, 666, 668, 785; 37/117.5, 120, DIG. 3, DIG. 12

[56] References Cited

U.S. PATENT DOCUMENTS

| | | | |
|---|---|---|---|
| 2,445,614 | 7/1948 | Flynn et al. | 414/607 |
| 2,473,505 | 6/1949 | Brock | 37/DIG. 3 |
| 2,635,884 | 4/1953 | Christiansen | 37/117.5 X |
| 3,023,919 | 3/1962 | Hobson | 414/607 |
| 3,032,220 | 5/1962 | Love | 414/607 |
| 3,075,661 | 1/1963 | Knutson | 37/117.5 |
| 3,325,023 | 6/1967 | Coleman | 414/724 |
| 3,421,642 | 1/1969 | Carter | 414/724 |
| 3,458,069 | 7/1969 | Wickberg et al. | 37/117.5 X |
| 3,477,600 | 11/1969 | Sawyer | 414/607 X |
| 3,512,672 | 5/1970 | Carpenter | 414/785 X |
| 3,667,633 | 6/1972 | Cappella | 414/724 |
| 3,795,331 | 3/1974 | Guest | 414/697 |
| 3,812,979 | 5/1974 | Leighgeber | 37/117.5 X |
| 3,825,139 | 7/1974 | Geis | 414/667 X |
| 3,921,837 | 11/1975 | Vandewater | 37/117.5 X |
| 4,117,610 | 10/1976 | Yates | 37/117.5 |
| 4,200,423 | 4/1980 | Sornsin | 37/117.5 X |
| 4,242,035 | 12/1980 | Hornstein | 37/117.5 X |

*Primary Examiner*—Joseph E. Valenza
*Assistant Examiner*—Terrance L. Siemens
*Attorney, Agent, or Firm*—Irvin A. Lavine

[57] ABSTRACT

A conventional front end loader bucket has a horizontal bottom plate, an upper inclined plate and a curved joining plate between them; each of a pair of support arms is pivotally connected at one end to the inner side of the loader bucket, at the juncture of the upper plate and the joining plate, and at the other end pivotally supports a tine. The arm may be channel shaped, and the tine pivots to a stored position within the channel of the support arm, and tine support arm pivots to a stored position adjacent the top plate. The support arm may be straight, or may have an angled portion at the end which supports the tine.

33 Claims, 12 Drawing Figures

Fig-1
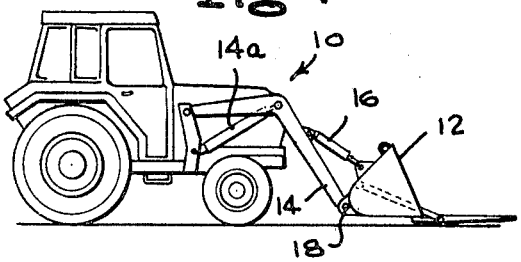
Fig-2
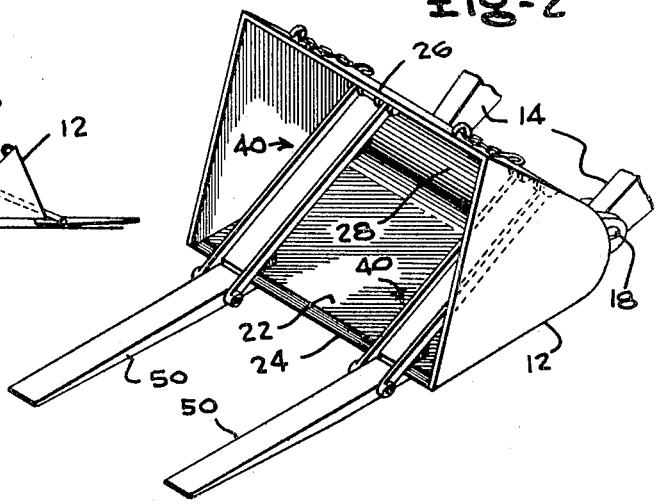
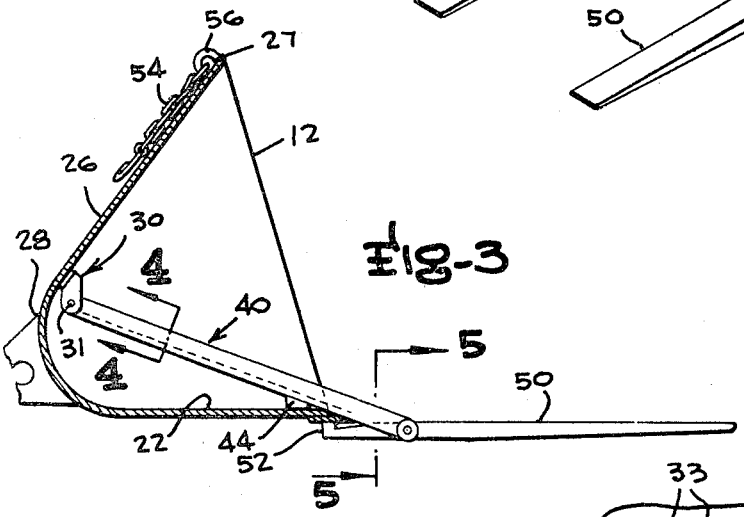
Fig-3
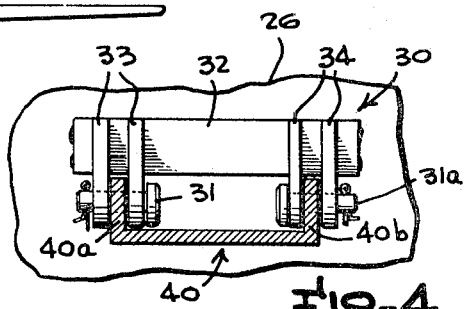
Fig-4
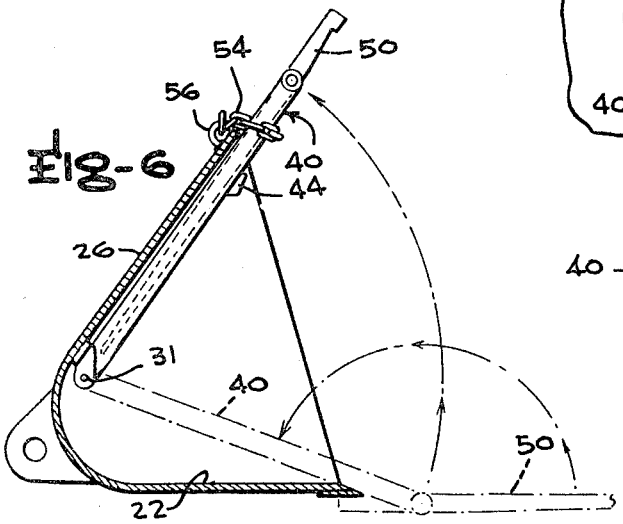
Fig-6
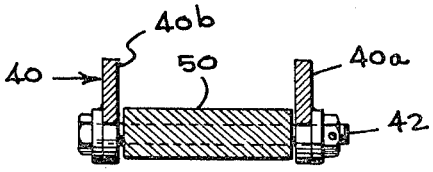
Fig-5

Fig-7
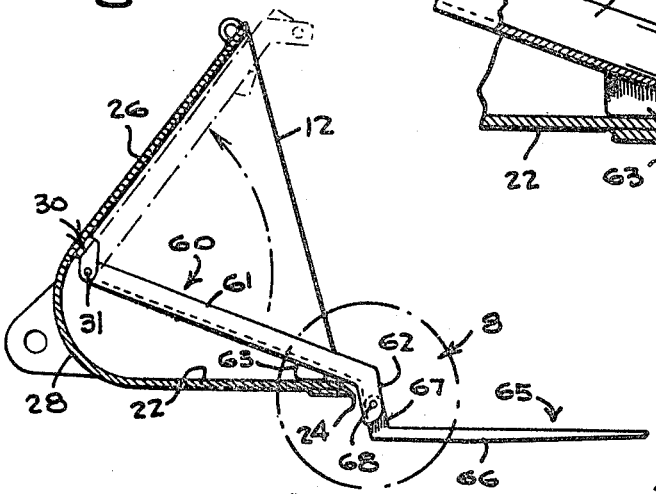
Fig-8
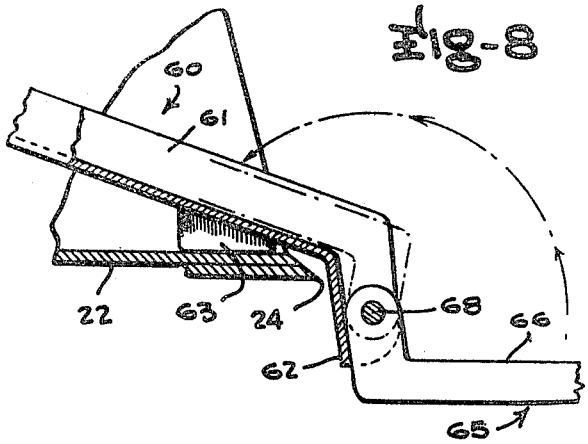
Fig-9
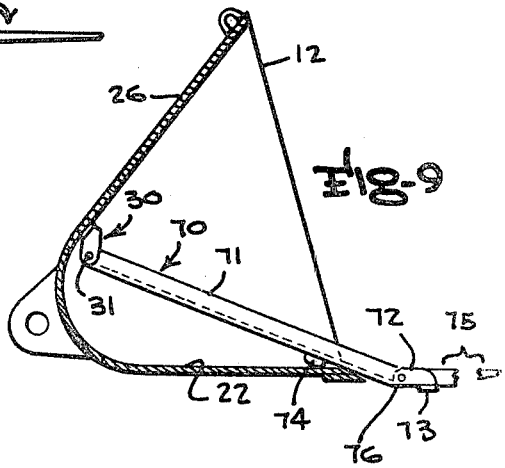
Fig-12
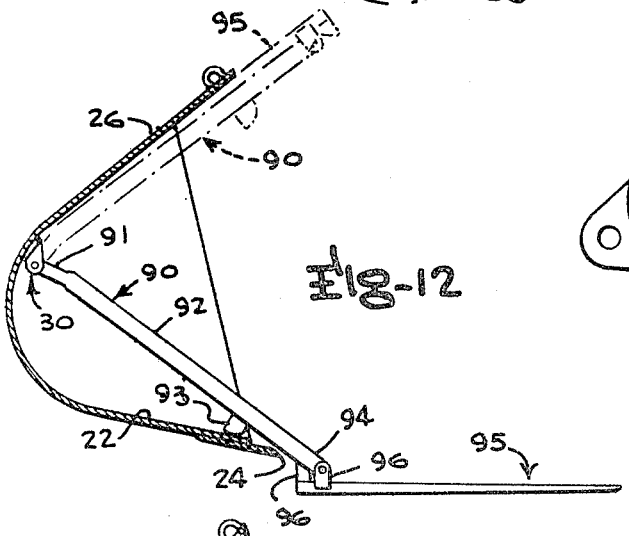
Fig-10
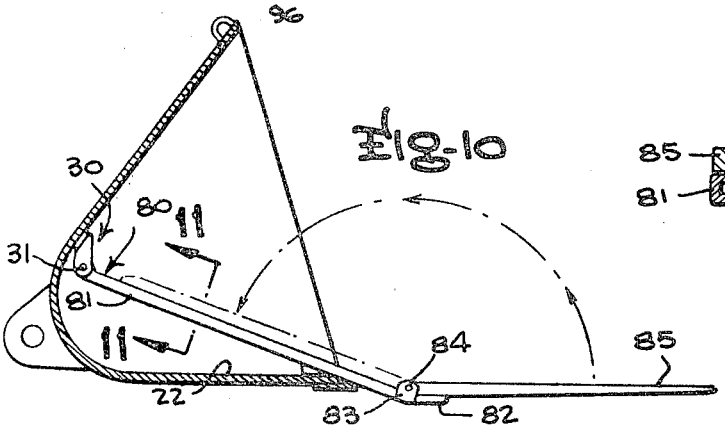
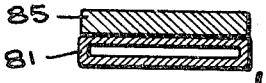
Fig-11

FOLD-AWAY FORK LIFT FOR LOADERS

BACKGROUND OF THE INVENTION

The present invention relates to a fork lift attachment, and more particularly to a fold-away fork lift attachment for the bucket of a loader.

It has been recognized that it is desirable to utilize such earth moving equipment as front end loaders and bulldozers for different tasks than that for which they were designed, including, specifically, the lifting of loads, particularly pipe and loads supported on a pallet. To this end, various proposals have been made for the provision of fork lift tines on such front end loader buckets and bulldozer blades.

Coleman U.S. Pat. No. 3,325,023 provides such an attachment wherein the tines are clamped to the bottom plate of the loader bucket; these tines, while effective for performing their task, had to be disconnected and removed from the bucket whenever it was necessary to discontinue the use of the equipment as a lift truck, and to revert to the use of the equipment as a front end loader, thus requiring a substantial amount of time of the workman.

It is also been known to provide a structure such as that shown in Coleman U.S. Pat. No. 3,325,023, but with a pivotal connection of the tines to a supporting clamp strucuture; this construction avoided the disassembly of the tines from the bucket, but interfered with the operation of the bucket as a front end loader, and also subjected the tines to being encased in the dirt or other material being loaded, as well as having the disadvantage of taking up space in the bucket.

Other constructions in which a fork lift attachment was provided on the bucket of a front end loader include Guest U.S. Pat. No. 3,795,331, Cappella U.S. Pat. No. 3,667,633 and Carter U.S. Pat. No. 3,421,642; these constructions each required complete removal of the fork lift attachment from the bucket in order to utilize the bucket as a front end loader, and therefore required considerable time for the assembly and disassembly of the attachment.

Brock U.S. Pat. No. 2,473,505 provides a fork lift attachment for a bulldozer blade which is connected to the blade by a plurality of bolts, and therefore is not readily convertible from one use to the other.

Yates U.S. Pat. No. 4,117,610 discloses an earth working machine having a conventional bulldozer blade and in association with it a scoop, which may be rotated on a horizontal axis relative to the bulldozer blade; a fork lift attachment is provided on the bulldozer blade, being pivotally connected to it, in order to maintain the load level as it is lifted. Apparently, the fork lift attachment must be removed in order to convert the equipment to earth working functions.

Hobson U.S. Pat. No. 3,023,919 provides a lift truck, having the tines thereof pivotable on a horizontal axis; no earth working function is disclosed to be possible with this construction. Christiansen U.S. Pat. No. 2,635,884 discloses an attachment for a tractor which includes a container having an open front end and a plurality of tines pivotally mounted at the open end, the tines being movable between horizontal and vertical positions in order to assist in loading the container. Leigheber U.S. Pat. No. 3,812,979 discloses a boom pivotally connected to the interior of the bucket of a front end loader.

SUMMARY OF THE INVENTION

The present invention is directed to the combination of the bucket of a front end loader and a fork lift attachment which may be pivotally connected to it. The attachment comprises a pair of support arms of identical construction, each having one end pivotally connected to the underside of the upper plate of the bucket, approximately at the location where the upper plate ends and the joining plate, which joins the upper plate and the bottom plate, begins, or, alternatively, attached to the side of the bucket at approximately the same location. Each support arm extends downwardly and forwardly, to approximately the front edge or lip of the bucket bottom plate, and then has an angled end portion or tine, extending generally horizontally, the tine being connected to the support arm subustantially at the juncture between the two portions thereof. The support arm is of channel shape, the channel facing upwardly, and being sized so as to receive therein the tine when it is folded about its pivotal connection with the support arm. Thus, the tine is folded into the main portion of the support arm, and then the support arm and the tine are folded against the underside of the upper plate.

Among the objects of the present invention are to provide a fork lift attachment for a bucket which, by being always attached to the bucket, will permit the conversion of the front end loader to and from fork lift usage with a minimum amount of down time, and little effort on the part of the workman. Another object of the present invention is to provide a fork lift atttachment which will require minimum modification of the front end loader bucket, and still another object is to provide an attachment which will, not, in many conditions of use, significantly diminish the volume of material which may be loaded into the bucket. A still further object is the provision of an attachment which will not be contacted by material in the bucket when the bucket is used as a loader, under many conditions of use. Another object is to provide a construction which minimizes risk of theft, since all attachment components may be welded.

Other objects and many of the attendant advantages of the present invention will be more readily understood from a consideration of the following specification, claims and drawings.

BRIEF DESCRIPTION OF THE DRAWING

FIG. 1 is an elevational view of a front end loader having the fork lift attachment in accordance with the present invention thereon.

FIG. 2 is a perspective view of a loader bucket with the fork lift attachment of the present invention attached thereto.

FIG. 3 is a transverse cross-sectional view on an enlarged scale showing the front end loader bucket and the fork lift attachment in position of use as a fork lift.

FIG. 4 is a cross-sectional view taken on the line 4—4 of FIG. 3.

FIG. 5 is a cross-sectional view taken on the line 5—5 of FIG. 3.

FIG. 6 is a view similar to FIG. 3, but with the fork lift attachment in folded or storage position.

FIG. 7 is a view similar to FIG. 3, showing an alternate construction of the fork lift attachment.

FIG. 8 is an enlarged view, partly in section, of the portion of FIG. 7 indicated by the circle 8.

FIG. 9 is a cross-sectional view similar to FIG. 3, and showing a further embodiment of the present invention.

FIG. 10 is a cross-sectional view similar to FIG. 3, and showing a still further embodiment of the present invention.

FIG. 11 is a cross-sectional view taken the line 11—11 of FIG. 10.

FIG. 12 is cross-sectional view similar to FIG. 3, and showing another embodiment of the present invention.

DESCRIPTION OF THE PREFERRED EMBODIMENT

Referring now to the drawings wherein like or corresponding reference numerals are used to designate like or corresponding parts throughout the several views, there is shown in FIG. 1 a front end loader generally designated 10, of generally conventional construction, and including a loader bucket 12 of conventional construction, supported by arms 14 which may be raised and lowered by cylinder 14*a*, there being a hydraulic motor 16 connected to the arms 14 and the bucket 12 to cause rotational movement of the bucket 12 about the pivotal connection 18 between bucket 12 and the arms 14.

The bucket 12, as shown in FIGS. 2 and 3, has a buttom plate 22 with a forward edge or lip 24, the bottom plate 22 generally being horizontal or substantially horizontal. Above the bottom plate 22 is an upper plate 26, the rear or bottom end of which is connected to or merges with a joining plate 28, here shown as a curved or arcuate joining plate which merges with the rear of the bottom plate 22 and the rear of the upper plate 26. The described constuction of the bucket 12 is a conventional and well known construction, although it will be understood that the joining plate 28 may, in other constructions, comprise one or more flat portions which form a closed end of the bucket between the bottom plate 22 and the upper plate 26, both of which are conventionally substantially planar.

A pair of lugs 30, only one of which is shown in FIG. 2, is provided on the interior of the bucket 12, preferably by being welded thereto. The lugs 30 are placed intermediate the edge 27 of the top plate 26 and the bottom plate 22, being specifically located substantially at the juncture of the top plate 26 and the joining plate 28. Pivotally connected to the lug 30 by pivot pin 31 is a straight support arm 40 which, in the use position shown in FIGS. 2 and 3, extends downwardly and forwardly to a point beyond the front edge or lip 24 of the bottom plate 22; the support arm 40 is in the form of an upwardly facing channel.

Pivotally connected to the support arm 40, is a tine 50, having, as shown in FIG. 5, a transverse passage for a bolt 42, about the axis of which the tine 50 may be pivoted. The bolt 42 is adjacent the rear end of tine 50, but spaced therefrom, and extends through the side flanges of support arm 40. At its rear end, the tine 50 is provided with an upstanding pad 52, and on the underside of the arm 40 there is provided a block 44, which engages the upper surface of the lip or edge portion 24 of the bottom plate 22 in the use position shown in FIG. 3.

Referring to FIG. 4, the attachment lug 30 will be seen to comprise a plate 32 which extends transversely, and which is preferably welded to the inside of the upper plate 26 of the bucket 12, near the lower end thereof. Extending downwardly from the plate 32 are a pair of ears 33, which are in adjacent, spaced apart relationship, and a similar pair of adjacent, spaced ears 34 are provided near the other end of the plate 32. All of the ears are provided with coaxial openings, the ears 33 receiving between them a flange 40*a* of support arm 40 and the ears 34 receiving between them the flange 40*b* of support arm 40. The pivot pin 31 is shown extending through holes in the ears 33 and through a hole in the flange 40*a*, and a similar pivot pin 31*a* extends in a hole in the flange 40*b* and in the ears 34. The pivot pins 31 and 31*a* are shown as being secured in position by a pair of conventional cotter keys, but, if desired, these pivot pins may be in the form of rivets, for example, so as to prevent their ready removal. Thus, a more secure fastening of the fork lift attachment support arm 40 to the bucket 12 may be provided, to avoid theft.

In FIGS. 1–3, it will be seen that the tines 50, in the use position shown, are below the bottom plate 22 of the bucket 12. With this provision, when the tines 50 are positioned beneath a load, as in the normal manner of lifting a pallet, the tine 50 will be lower than the bottom plate 22, and will engage the ground, and will not be interfered with by the bottom plate 22 of the bucket 12. Thus, to use the fork lift attachment of the present invention to lift loads, such as palletized loads, the front end loader is maneuvered in the usual fashion, the arms 14 being raised or lowered so as to place the tines 50 at the desired level, with the bucket 12 being pivoted about the connection 18 by the motors 16, so as to maintain the tines 50 substantially level, and thereafter loads are lifted, transported and deposited. When it is desired to convert the apparatus to use as a front end loader, it is only necessary, as shown in FIG. 6, to pivot the tine 50 about the bolt 42, as indicated by the dashed arrow, so that the tine 50 lies within the channel which forms the support arm 40. Then, the support arm 40 is pivoted, together with the tine 50 which is housed within it, about the pivot pins 31, 31*a* extending through the lug 30, and extends along and adjacent the underside of the upper plate 26, as shown in full lines in FIG. 6. It may be secured in this position by any suitable means, such as by a chain 54 secured to an eye 56 attached to the upper surface of upper plate 26. In this position, which is the stored or non-use position, the support arm 50 lies against the underside of the upper plate 26, and the use of the front loader for loading and moving dirt and the like may then begin, with a minimum of down time and a minimum of time of the workman used for the conversion. In the stored position, the dirt or other material loaded into the loader bucket 12 will usually not come in contact with the fork lift attachment, including the support arms 40, and therefore the support arms 40 will not take up significant space within the bucket 12 and diminish its capacity, nor will the support arm 40 be subject to engagement by the dirt, which would tend to have a harmful effect upon it.

In FIGS. 7 and 8, there is shown an alternate embodiment of the fork lift attachment, in which the support arm 60 has a main portion 61 and a downturned, angled portion 62, the latter being at the end of the support arm 60 opposite to the end which is pivotally connected by pivot pin 31 to bracket 30. A pad 63 is secured to the underside of the support arm 60, and rests upon the outer portion of bottom plate 22. The angled portion 62 is directed downwardly, in front of the line 24 of the bucket 12. The tine 65 has a main portion 66, and, at its inner end, an angled portion 67. The pivot pin 68 pivotally connects the tine 65 to the support arm 60, extending through the angled portions 62 and 67, respectively.

The angle between the main portion 61 and angled portion 62 of support arm 60 is substantially the same as the angle between the main portion 66 and angled portion 67 of the tine 65, and the distance between the pivot pin 68 and the main portions 61 and 66 is substantially the same, so that, as is indicated by the arrow in FIG. 8, the tine 65 may be rotated about the pivot pin 68 from the solid line position to the dotted line position, the main portion 66 of the tine 65 being received in the upwardly facing channel of the main portion 61 of support arm 60. In the solid line position, particularly as shown in FIG. 8, it will be seen that the web of the angled portion 62 of the support arm 60 serves to limit the rotation of tine 65 in a clockwise manner, when tine 65 is in the use position, and that the web of the main portion 61 serves to limit the rotation of the tine 65 in a counter clockwise direction, so as to stop it when it reaches the fully stored position. Once the tine 65 has been pivoted to the stored position, as shown in dotted lines in FIG. 8, the support arm 60 is then pivoted about pivot pin 31 to the dotted line position shown in FIG. 7, in the direction indicated by the arrow. Then the fork lift attachment shown in FIGS. 7 and 8 is secured by suitable means, such as a chain, as illustrated in FIG. 6. The lug 30 shown in FIG. 7 will be understood to be of substantially the same construction as is shown in FIG. 4. The main portion 66 of the tine 65 will be seen to be substantially below the bottom plate 22.

FIG. 9 discloses a support arm 70 of channel shape, supported by the lug 30 and pivot pin 31. The support arm 70 includes a main portion 71 and an angled portion 72 which is substantially horizontal in the use position shown, unlike the portion 62 of support arm 60, which is nearly vertical in the use position. At its outer end, the angled portion 72 includes a transverse bar 73, and there is provided a tine 75 which is straight, and pivotally connected to the support arm 70 by a pivot pin 76 located substantially at the juncture between the straight portion 71 and angled portion 72 of support arm 70. The transverse bar 73 serves to position the tine 75, and also will permit gravel or dirt which may enter between the lower surface of tine 75 and the upper surface of support bar 73 to pass beyond support bar 73, to the left or rearwardly, and become free of the fork lift attachment. This avoids rocks and dirt lodging in the fork lift attachment and thereby causing the tine 75 to be at an angle which is not desired. A support pad 74 is provided on the underside of the main portion 71, and rests upon the bottom plate 22 of the bucket 12. The main portion 71 of support arm 70 extends sufficiently downwardly, so that the tine 75 will be in proper position to engage a load, without interference with the bottom plate 22. In this embodiment, the tine 75 may be rotated to a position in which it is housed in or nested within the channel formed by the main portion 71 of support arm 70, and then the latter may be rotated to a position adjacent the upper plate 26.

FIG. 10 discloses a support arm 80 which has a main support 81, and an angled end portion 82. As shown in FIG. 11, the support arm 80 is not channel shaped, but is of flattened tubular shape. It may also be made of a solid bar. It does not, however, have the ability to receive or house or nest a tine, as do the other embodiments hereinabove described. Substantially at the juncture between the main portion 81 and the angled portion 82 of support arm 80 will be seen to extend below the bottom plate 22, and will also be seen to serve as a stop member for the tine 85. The tine 85 may be rotated to the stored position as indicated by the arrow shown in FIG. 10, wherein it will lie upon the main portion 81, in the manner shown in FIG. 11. Then the support arm 80 may be pivoted upwardly about pivot pin 31 of the lug 30 as in the previous embodiment.

In FIG. 12, there is shown a still further embodiment, in which the support arm 90 has an end portion 91 which is relatively smaller than the main portion 92, the end portion 91 being pivotally connected to the attachment lug 30. A pad 93 depends from the underside of the main portion 92, and engages the bottom plate 22 of the front end loader bucket. The end 94 of the support arm 90 will be seen to extend downwardly in front of the lip or front edge 24 of the bucket, and to the outer end there is pivotally attached a tine 95. The attachment is effected by a pair of ears 96 which extend upwardly from the tine 95. at the rear thereof, and at its rear end tine 95 is provided with a pad 96 which engages the underside of the support arm 90. As is clear from the dashed line showing in FIG. 12, the tine 95 may be folded so as to lie against the upper surface of the support arm 90, and then the support arm 90 may be pivoted about the attachment lug 30, into the stored position shown in dashed lines.

There have been disclosed fork lift attachments for use with a front end loader bucket, and a front end loader bucket and fork lift attachment combination. Several embodiments of the fork lift attachment have been provided, and in each case, the fork lift attachment may be relatively permanently attached to the bucket, and be moved between use positions and storage positions with minimum effort and down time. When in the stored position, the fork lift attachments are in position so as not to be engaged or to be minimally engaged by dirt or other material which is loaded into the bucket, and the fork lift attachments do not take up a substantial amount of space with in the bucket of the front end loader.

It will be obvious to those skilled in the art that various changes may be made without departing from the spirit of the invention, and therefore the invention is not limited to what is shown in the drawing and described in the specification but only as indicated in the appended claims.

I claim:

1. A fork lift attachment for a loader bucket having an upper inclined plate, the attachment being capable of occupying a first position in which a tine extends forwardly of said bucket and a second position in which said tine extends along the upper inclined plate, comprising:

(a) a linearly extending support arm having pivotal engaging means at one end thereof for pivotally connecting said support arm to the loader bucket for enabling said support arm to occupy a first position extending downwardly from the interior of the loader bucket or a second position wherein said support arm extends along the underside of the loader bucket upper plate, (b) a tine having a forward end and a rear end, and (c) means adjacent the rear end of said tine for pivotally connecting said tine to said support arm at the other end thereof for movement between a first position extending forwardly of said support arm and a second position substantially adjacent said support arm.

2. The fork lift attachment of claim 1, said support arm being straight.

3. The fork lift attachment of claim 2, said last mentioned means comprising a pivot pin extending transversely of said tine forwardly of and adjacent to the rear end thereof.

4. The fork lift attachment of claim 3, said tine at the rear end thereof having an upstanding pad.

5. The fork lift attachment of claim 1, said support arm being of channel shape and said tine being stored in said channel of said support arm in said second position thereof.

6. The fork lift attachment of claim 5, said support arm comprising a main portion and an inclined end portion at the said other end.

7. The fork lift attachment of claim 1, said support arm comprising a main portion and an angled portion at said other end.

8. The fork lift attachment of claim 7, said tine having a main portion and an angled portion, said last mentioned means pivotally connecting the angled portions of said support arm and said tine, the angle between the main and angled portions of said support arm and said tine being substantially the same and the distance between said pivotally connecting means and said main portions being substantially the same, whereby said tine may be pivoted to a stored position in adjacent relationship to said arm.

9. The fork lift attachment of claim 8, said support arm being of channel shape and said tine being stored in said channel of said support arm in said second position thereof.

10. The fork lift attachment of claim 7, said angled portion comprising a transverse bar underlying said tine when said tine is extended.

11. The fork lift attachment of claim 10, said support arm being of channel shape and said tine being stored in said channel of said support arm in said second position thereof.

12. The fork lift attachment of claim 1, said support arm having a pad adjacent the other end thereof.

13. The fork lift attachment of claim 12, said tine having a pad adjacent the rear end thereof and rearwardly of the pivotal connection of the tine and the said support arm.

14. In combination with a front end bucket having a bottom plate with a lip, an upper inclined plate and adjoining plate means between the said plates, a fork lift attachment comprising:

a tine, and means comprising a support arm for mounting said tine for movement between a first, use position wherein said tine extends forwardly of the front lip of the bucket and a second, storage position in which said tine extends along the underside of said upper plate.

15. The combination of claim 14, and means for pivotally connecting one end of said support arm to the interior of said bucket.

16. The combination of claim 5 said last mentioned means comprising means for pivotally connecting said one end of said support arm intermediate the edge of the top plate and the bottom plate.

17. The combination of claim 15, said last mentioned means comprising means for pivotally connecting said one end of said support arm substantially at the juncture of said top plate and said joining plate means.

18. The combination of claim 15, 16, or 17, and means for pivotally connecting said tine to the support arm adjacent the other end thereof.

19. The combination of claim 15, said support arm having a pad on the underside thereof engaging the bottom plate of the bucket.

20. The combination of claim 15, said support arm being straight and extending beyond said lip, means pivotally connecting an end of the support arm beyond said lip to said tine intermediate the ends thereof, said tine having a rear end extending beneath said bottom plate.

21. The combination of claim 20, said rear end of said tine engaging said bottom plate.

22. The combination of claim 15, said support arm having an angled portion extending downwardly in front of the lip of said bucket, and means at said angled end for pivotally connecting said tine to said bucket.

23. The combination of claim 22, said tine having a main portion extending generally horizontal in the use position, and an angled portion at the rear having substantially the same angle as the angle between the two portions of said support arm.

24. The combination of claim 23, said support arm being an upwardly facing channel and said tine being housed therein in the pivoted, stored positions thereof.

25. The combination of claim 15, said support arm having an angled portion extending generally horizontal, said means for mounting said tine comprising means pivotally connecting said tine to said support arm adjacent the juncture of said portions of said support arm.

26. The combination of claim 25, and a transverse bar at the free end of said angled portion for engagement by the underside of said tine.

27. The combination of claim 26, said support arm being an upwardly facing channel and said tine being housed therein when in the pivoted, stored position thereof.

28. The combination of claim 25, said angled portion extending beneath said tine for engagement by the underside thereof.

29. The combination of claim 15, said support arm being flat and said tine lying thereon in the pivoted, stored position thereof.

30. The combination of claim 14, said support arm comprising upwardly open channel means for receiving said tine therein.

31. The combination of claim 14, said means mounting said tine in a first, use position in which said tine is below the bottom plate of said bucket.

32. The combination of claim 15, said support arm having a pad on the underside thereof engaging the bottom plate.

33. A combination of claim 15 or 31, the tine having a pad at the rear thereof engaging the underside of said support arm.

* * * * *